US007244120B2

(12) United States Patent
Jiang

(10) Patent No.: US 7,244,120 B2
(45) Date of Patent: Jul. 17, 2007

(54) IGNITER GUN EQUIPPED WITH A SAFETY MECHANISM

(75) Inventor: Zhihong Jiang, Sankai Corporation, Development Zone, Zhangqi Town, Cixi City, 315313, Zhejiang Province (CN)

(73) Assignees: Guoliang Lou, Cixi (CN); Zhihong Jiang, Cixi (CN)

( * ) Notice: Subject to any disclaimer, the term of this patent is extended or adjusted under 35 U.S.C. 154(b) by 261 days.

(21) Appl. No.: 11/010,401

(22) Filed: Dec. 14, 2004

(65) Prior Publication Data

US 2005/0142510 A1 Jun. 30, 2005

(30) Foreign Application Priority Data

Dec. 30, 2003 (CN) ..... 2003 2 0123098 U

(51) Int. Cl.
*F23Q 2/16* (2006.01)
*F23Q 7/24* (2006.01)

(52) U.S. Cl. ..... 431/153; 431/255

(58) Field of Classification Search ..... 431/153, 431/255

See application file for complete search history.

(56) References Cited

U.S. PATENT DOCUMENTS 5,931,656 A * 8/1999 Kanno ..... 431/153
6,126,427 A * 10/2000 Elleder et al. ..... 425/38
6,135,762 A * 10/2000 Hu ..... 431/153
6,168,420 B1 * 1/2001 Sung ..... 431/153
6,186,773 B1 * 2/2001 Sung ..... 431/153
6,217,313 B1 * 4/2001 Luo ..... 431/153
6,244,858 B1 * 6/2001 Wang ..... 431/153
6,468,070 B1 * 10/2002 Jon ..... 431/153
6,604,939 B1 * 8/2003 Li ..... 431/153
6,644,958 B1 * 11/2003 Li ..... 431/153
6,682,340 B2 * 1/2004 Kim ..... 431/153
6,688,878 B1 * 2/2004 Rogelet ..... 431/153
6,722,877 B2 * 4/2004 Wang et al. ..... 431/153
7,001,175 B2 * 2/2006 Yang ..... 431/153

FOREIGN PATENT DOCUMENTS

CA 2261354 A * 8/2000
CA 2261356 A * 8/2000
CA 2293109 A * 6/2001
EP 1 271 055 A * 2/2003

* cited by examiner

*Primary Examiner*—Carl D. Price
(74) *Attorney, Agent, or Firm*—Rabin & Berdo, P.C.

(57) ABSTRACT

The invention is an igniter gun equipped with a safety mechanism. The invention is characterized in that a lever is provided between a piezoelectric pusher and a trigger, with a first end of the lever pivotally connected to the casing, the second end and middle portion of the lever abutting against the trigger and the piezoelectric pusher respectively; one end of a gas controller is connected with a gas outlet valve, while another end of the gas controller forms a hook that abuts against the first end of the lever, a safety spring which urges the hook to go beyond a movement range of the first end of the lever is set between one side of the gas controller and a casing, a controller switch abutting against a back of the hook is set between another side of the gas controller and the casing, the controller switch is pivotally connected to the casing, and a portion of the controller switch exposed outside the casing.

4 Claims, 5 Drawing Sheets

IGNITER GUN EQUIPPED WITH A SAFETY MECHANISM

FIELD OF THE INVENTION

The invention relates to an igniter device, concretely relates to an easily operated igniter gun equipped with a safety mechanism.

BACKGROUND OF THE INVENTION

A current igniter gun is not provided with a safety mechanism, and is not restrictive to the manipulation of trigger. Thus, the current igniter is apt to be ignited to hurt children or even endanger the public safety if it is mistakenly manipulated by accident, or children playing with it accidentally knock against the trigger of the igniter gun by hard objects. Meanwhile a gas outlet valve may be opened to discharge inflammable gas if the trigger is pushed down accidentally by external force, so the production and sale of igniter gun without safety mechanism equipped have been or are going to be forbidden in some countries and areas. For this reason, an igniter gun with a safety switch (or mechanism) equipped has been developed, in which the safety switch (or mechanism) controls the course of the piezoelectric member of the igniter gun and prevents the piezoelectric member from discharging spark. However, the current igniter gun does not control the gas outlet valve. Accordingly, the gas outlet valve may be opened still even when the piezoelectric member is prohibited to discharge (i.e. the safety state) Thus, a hidden danger of inflammable gas leaking existed. Meanwhile, the current igniter gun has a drawback of difficult manipulation and hard hand feeling for its trigger propping directly against the top end of piezoelectrics pusher and a big force is needed when pushing the trigger down.

BRIEF DESCRIPTION OF THE INVENTION

The present invention is provided to eliminate the deficiency and drawback in current technology and provide an easily operated igniter gun equipped with safety mechanism for gas outlet valve operation controlling, which can decrease manipulation force and control effectively the operation state of the gas outlet valve.

The technology scheme by the invention has following constitution: An igniter gun comprises a casing, a gun tube above the casing, a liquefied fuel container within the casing, a gas outlet assembly and an igniting assembly above the liquefied fuel container, a gas controller, a safety spring, and a controller switch. The gas outlet assembly comprises a gas outlet valve and a gas outlet nozzle. The igniting assembly comprises a piezoelectric member, a piezoelectric pusher, a trigger above the piezoelectrics pusher, and a lever. The lever is provided between the piezoelectric pusher and trigger. A first end of the lever connected pivotally to the casing, while a second end and middle part of the lever abutting against a surface of the trigger and the piezoelectric pusher respectively. One end of the gas controller is connected with the gas outlet valve, while the other end of the gas controller forms a hook abutting on the first end of the lever. The safety spring that forces the hook to go beyond a movement range of the first end of the lever is set between one side of the gas controller and the casing. The controller switch abutting against back of the hook is set between another side of the gas controller and the casing, and at the same time is connected pivotally to the casing with at least a portion of the controller switch being exposed outside the casing.

In normal condition (i.e. the safety state), the hook goes beyond movement range of the first end of the lever by the safety spring. Thus, even if the trigger is to be pressed down directly at this time, the first end of the lever cannot move the hook. Although the action of the trigger may produce spark, the gas outlet valve hasn't been opened, the igniter gun produces no flame, and the safety property of the igniter gun is hence greatly improved.

The operation state of the invention is as follows: 1. Push the controller switch upward to make it turn around the rod, the hook on one end of the gas controller is pushed to move, the safety spring is pressed down and the hook is within the movement range of the first end of the lever, if the trigger is pushed down at this time, the first end of the lever can move the hook; 2. The further downward movement of the trigger could bring the hook to move upward, the gas outlet valve may be opened with the upward movement of the hook, the piezoelectric member would produce high voltage spark to ignite the combustible gas discharged from the gas outlet valve; 3. The safety spring is reset automatically after trigger releasing, the gas controller and the controller switch are reset by the safety spring, the lever is reset along with the trigger, and the igniter gun is under the normal safety state again.

The igniter gun may further comprise a locker between the trigger and the controller switch. A middle portion of the locker is connected pivotally with the casing, one end of the locker abuts on the trigger, and the other end of the locker is connected with a middle portion of the controller switch by a rod. The locker may further include a movement groove for turning controller switch at a connecting position with the controller switch. The locker serves to lock the operation state of the trigger, control effectively the operation of the trigger, improve further the safety property of the igniter gun and realize a double safeguard of the igniter gun, because it can control effectively both operations of the gas outlet valve and the trigger. In time of the locker pushing upward the controller switch by the controller switch controlling, it turns around the rod and the middle portion of the locker moves within the movement groove, in this way, the hook can act within the movement range of the first end of the lever and the end of the locker abutting the trigger may get off the trigger.

In the igniter gun, the middle of the controller switch is abutting against a back of the hook and one end is connected pivotally to the casing.

The invention has the following technical effects by supplementing a lever, a gas controller and a trigger, and controlling the gas controller and the locker by the controller switch: (1) Easy, smooth, flexible and nice hand feeling operation of the trigger by lever principle; (2) In operation, the controller switch can control effectively the operation of the trigger as well as the gas outlet valve, and, thus, a double safeguard of the igniter gun is realized, thereby preventing the mistake operation, making it more difficulty for children to operate it and improving greatly the safety property of the igniter gun.

Next, a further description will be made as to the invention with the Specification Figures and Embodiments.

BRIEF DESCRIPTION OF THE APPENDED DRAWINGS

DETAILED DESCRIPTION OF THE INVENTION

Embodiment 1

Figure 1:
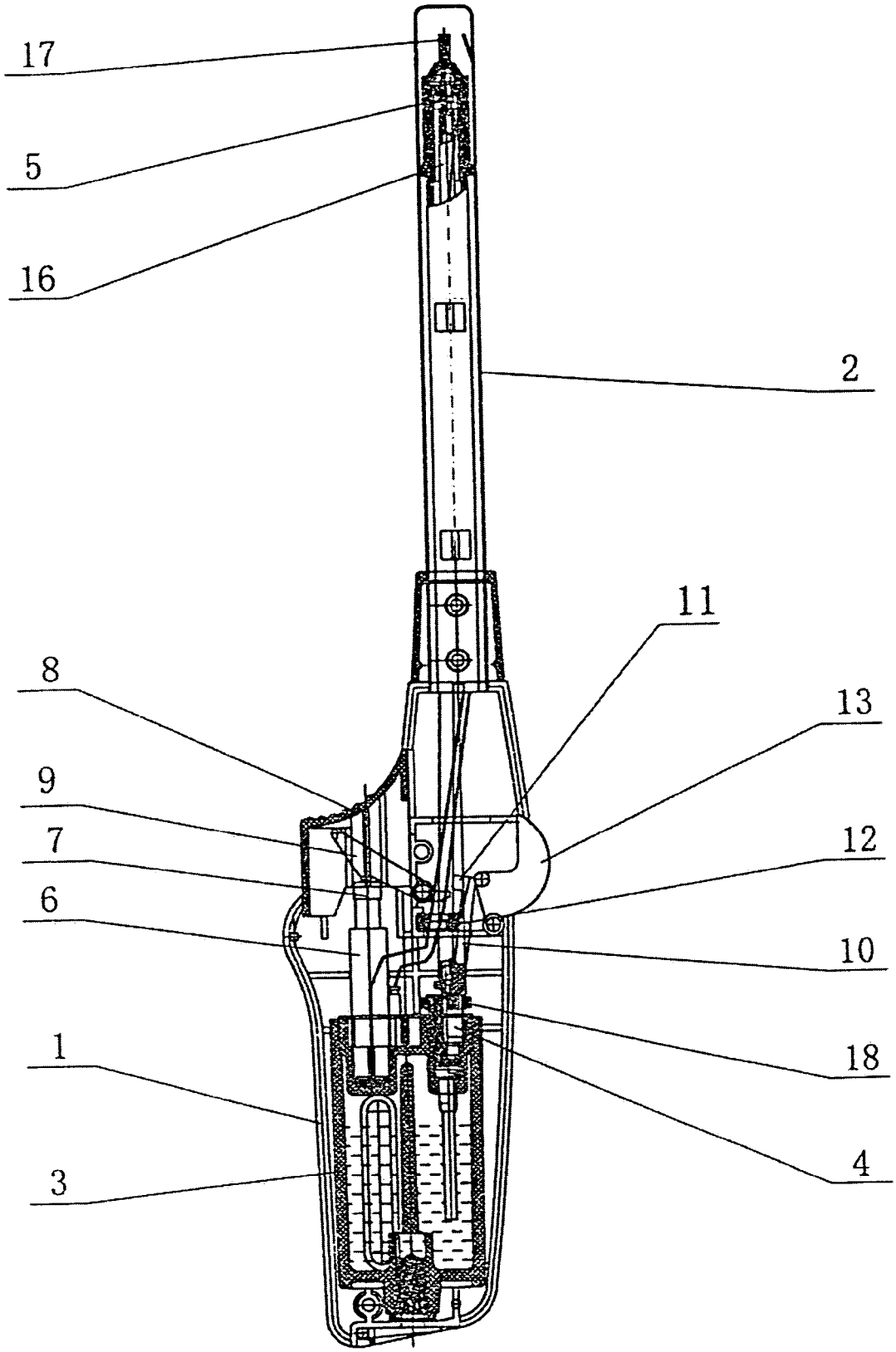
FIG. 1 is an illustrative view showing a normal state (i.e. safety state) of an igniter gun according to embodiment 1 of the invention.
Figure 2:
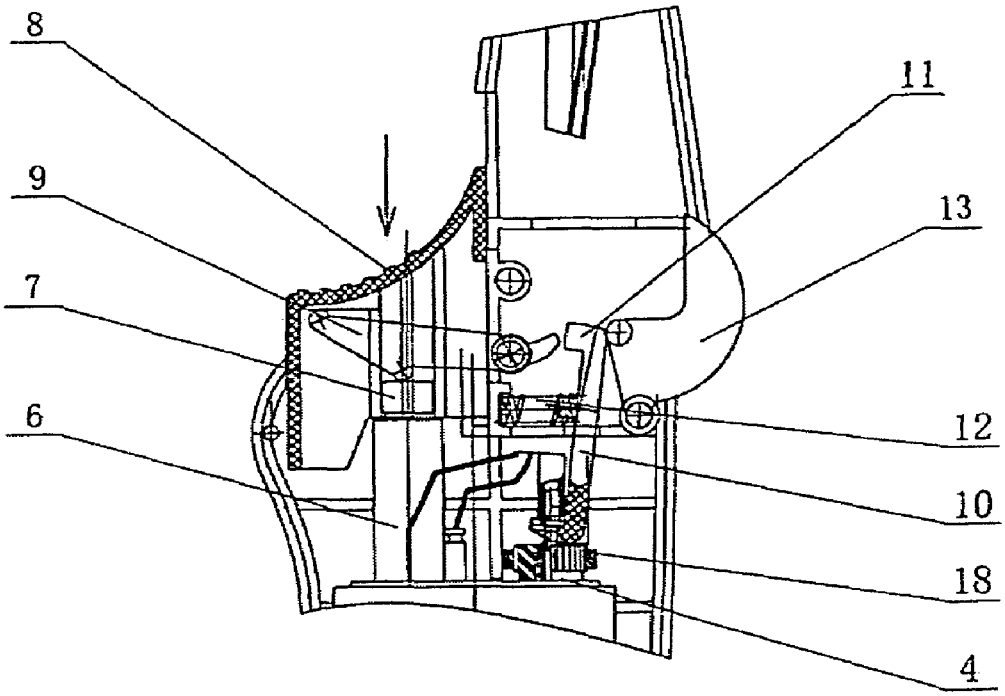
FIG. 2 is an illustrative view showing that a trigger is fully pressed down and a gas outlet valve isn't opened in embodiment 1.
Figure 3:
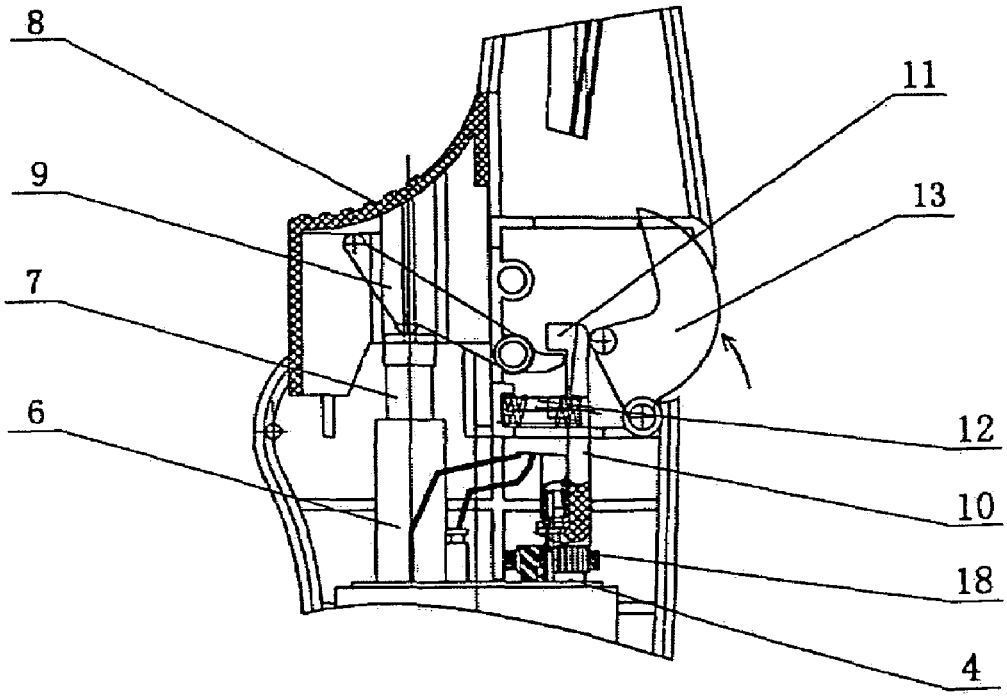
FIG. 3 is an illustrative view showing the opened state of controller switch in embodiment 1.
Figure 4:
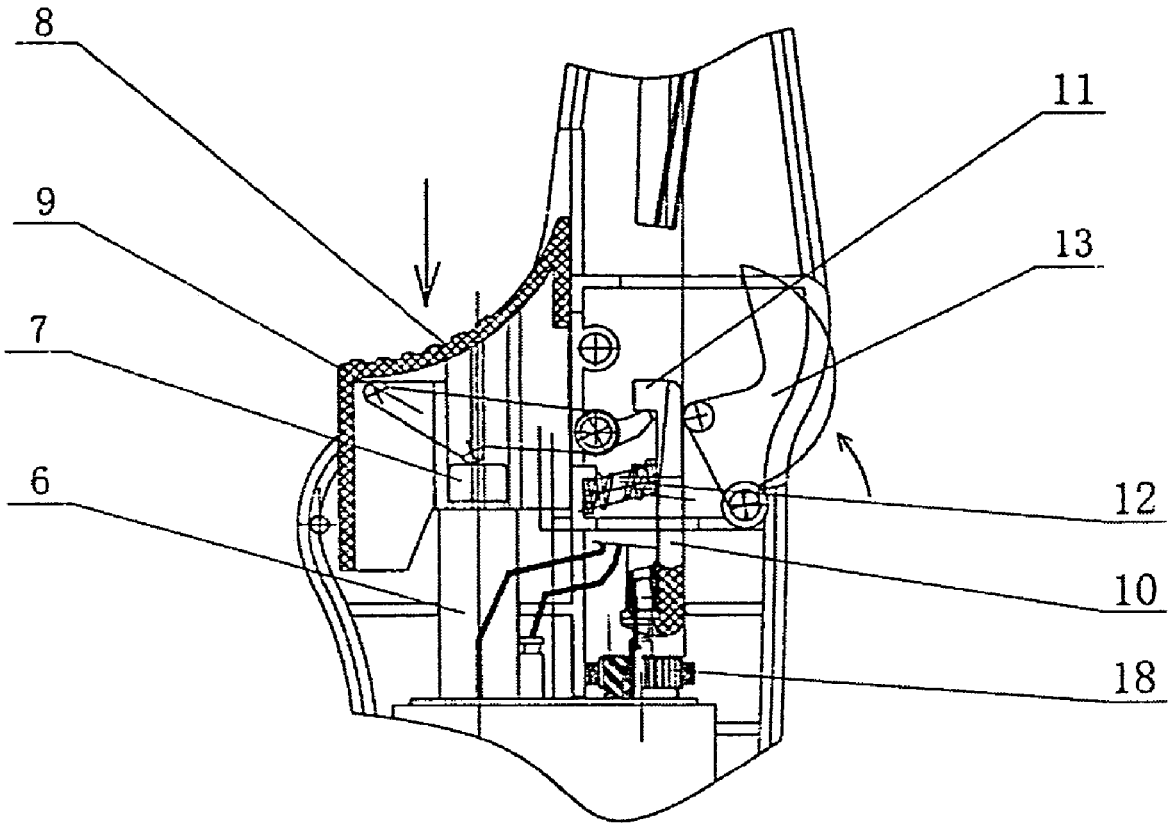
FIG. 4 is an illustrative view showing an operation state of the igniter gun in embodiment 1.

Referring to FIGS. 1-4, an igniter gun that can be operated safely and easily is provided. The igniter gun comprises casing 1, a gun tube 2 above the casing 1, a liquefied fuel container 3 within the casing 1, a gas outlet assembly and an igniting assembly above the liquefied fuel container 3

The gas outlet assembly comprises gas outlet valve 4, a gas outlet nozzle 5, a gas outlet tube 16, an igniter spring 17 and a fire adjusting ring 18. One end of the gas outlet nozzle 5 is accommodated in the gun tube 2, while the other end of the gas outlet nozzle 5 is connected with the liquefied fuel container 3 via the gas outlet valve 4.

The igniting assembly comprises a piezoelectric member 6, a piezoelectrics pusher 7 and a trigger 8 above the piezoelectrics pusher 7, and a lever 9. One end of the piezoelectric member 6 is connected to the liquefied fuel container 3, while the other end of the piezoelectric member 6 is connected with one end of the trigger 8 via the piezoelectric pusher 7. The lever 9 is provided between the piezoelectric pusher 7 and the trigger 8. A first end of the lever 9 is connected pivotally to the casing 1, while a second end and middle part of the lever 9 is abutting against a surface of the trigger 8 and the piezoelectric pusher 7 respectively.

The igniter gun further comprises a gas controller 10 that is slip-jointed with the gas outlet valve 4. One end of the gas controller 10 is connected with the gas outlet valve 4 in a nested relation, while the other end of the gas controller 10 forms a hook 11 that abuts on the first end of the lever 9.

The igniter gun further comprises a safety spring 12 and a controller switch 13. The safety spring that could force the hook 11 to go beyond the movement range of the first end of the lever 9 is set between one side of the gas controller 10 and the casing 1. The controller switch 13 is set between another side of the gas controller 10 and the casing 1. A middle portion of the controller switch 13 abuts against the back of the hook 11, one end of the controller switch 13 is connected pivotally to the casing 1, and another partial portion of the controller switch is exposed outside the casing 1.

In normal condition, the hook 11 on one end of the gas controller 10 goes beyond the movement range of the first end of the lever 9 by the safety spring 12. Accordingly, even if the trigger 8 is to be pressed down directly at this time, the first end of the lever 9 cannot move the hook 11. That is, although the spark may be produced by pushing down the trigger 8 to bottom, the gas outlet valve 4 cannot be opened, and, therefore, the igniter gun produces no flame and cannot operate (See FIG. 2).

The operation is as follows. When the controller switch 13 is pushed upward so as to turn around the rod, the hook 11 on one end of the gas controller 10 is pushed to move, the safety spring 12 is pressed down, and the hook 11 is within the movement range of the first end of the lever 9. If the trigger 8 is pushed down at this time, the first end of the lever 9 is moved with the hook 11. The further downward movement of the trigger 8 forces the hook 11 to move upward, and the gas outlet valve 4 may be opened with the upward movement of the hook 11. The piezoelectric member 6 would produce a high voltage spark to ignite the combustible gas discharged from the gas outlet valve 4. The safety spring 12 is reset automatically after the trigger 8 is released, the gas controller 10 and the controller switch 13 are reset by the safety spring 12, the lever 9 is reset along with the trigger 8, and the igniter gun is under the normal safety state again.

Embodiment 2

Figure 5:
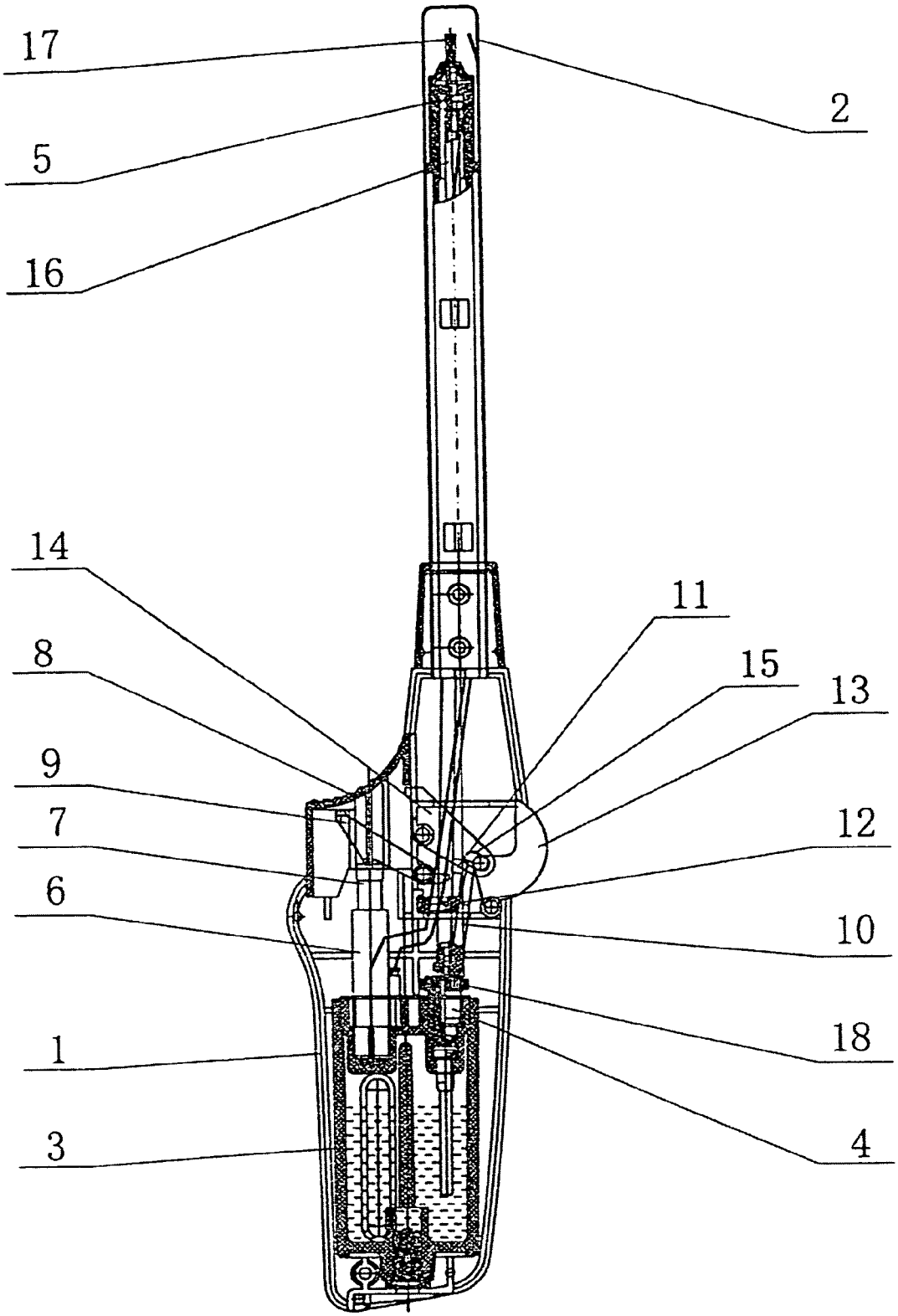
FIG. 5 is an illustrative view showing a normal state of an igniter gun according to embodiment 2 of the invention.
Figure 6:
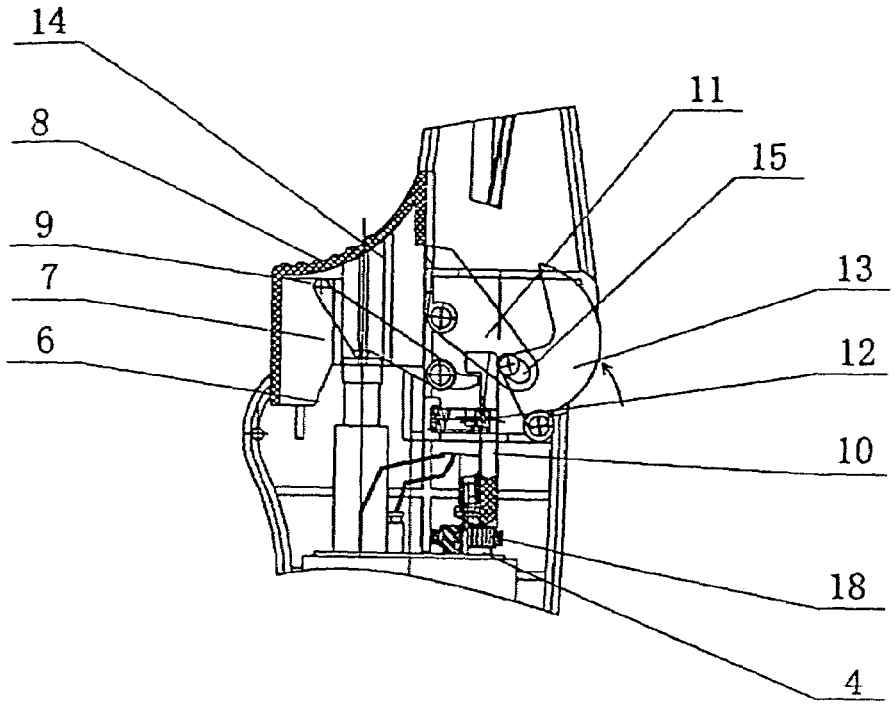
FIG. 6 is an illustrative view showing the opened state of controller switch in embodiment 2.
Figure 7:
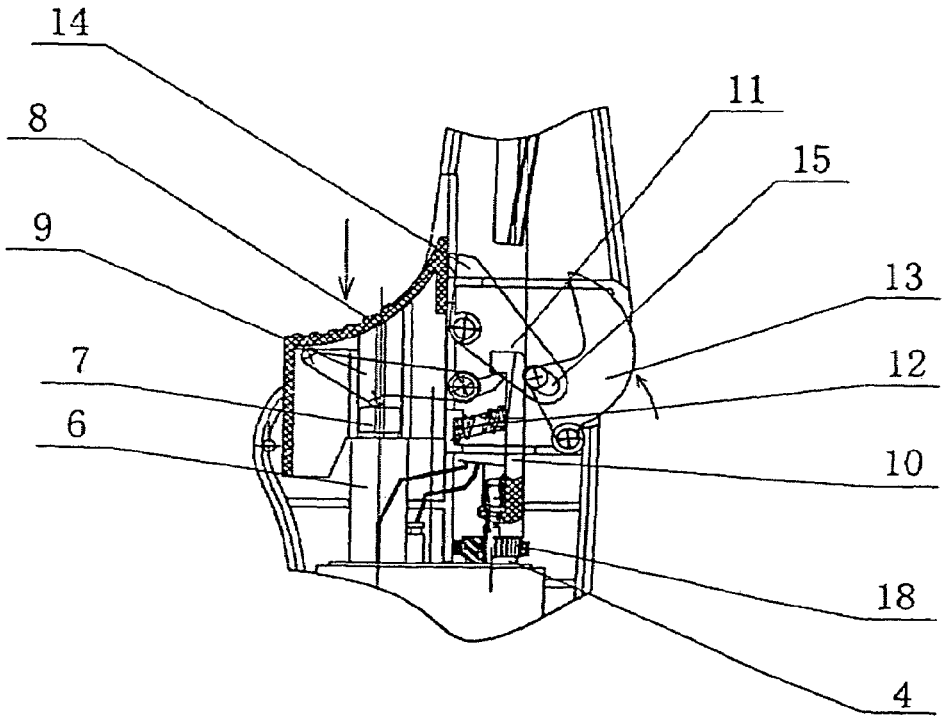
FIG. 7 is an illustrative view showing an operation state of the igniter gun in embodiment 2.

Referring to FIGS. 5-7, embodiment 2 of the present invention includes the following differences from embodiment 1. A locker 14, of which the middle portion is connected pivotally with the casing 1, is set between the trigger 8 and the controller switch 13. The locker 14 abuts against the trigger 8. One end of the locker 14 abuts on the trigger 8, while the other end of the locker 14 is connected with the middle portion of the controller switch 13 by a rod. The locker 14 has a movement groove 15 for turning the controller switch 13 at connecting position with the controller switch 13.

In normal condition, the trigger 8 is locked by the locker 14 and the trigger cannot be pressed down. Even the locker 14 is destroyed by a great force and the trigger 8 may be pressed down to the bottom, but the hook 11 on one end of the gas controller 10 may goes beyond the movement range of the first end of the lever 9 by the safety spring 12, the first end of the lever 9 cannot move the hook 11, the gas outlet valve 4 hasn't been opened, the igniter gun produces no flame and cannot operate still. Accordingly, the invention has a double safety function under normal state.

The operation is as follows. When the controller switch 13 is pushed upward so as to turn around the rod, the hook 11 on one end of the gas controller 10 is pushed to move, the locker 14 turns around the rod, the safety spring 12 is pressed down, the hook 11 is within the movement range of the first end of the lever 9 and the end of locker 14 abutting on the trigger 8 goes off the trigger 8. If the trigger 8 is pushed down at this time, the first end of the lever 9 can move the hook 11. The further downward movement of the trigger 8 forces the hook 11 to move upward, and the gas outlet valve 4 may be opened with the upward movement of the hook 11. The piezoelectric member 6 would produce high voltage spark to ignite the combustible gas discharged from the gas outlet valve 4. The safety spring 12 is reset automatically after the trigger 8 is released, the gas controller 10, the locker 14 and the controller switch 13 are reset by the safety spring 12, and the lever 9 is reset along with the trigger 8, and the igniter gun is under the normal safety state again.

I claim:

1. An igniter gun, comprising:

a casing;

a gun tube above the casing;

a liquefied fuel container within the casing;

a gas outlet assembly including a gas outlet valve and a gas outlet nozzle, one end of the gas outlet nozzle being accommodated in the gun tube, another end of the gas outlet nozzle being connected with the liquefied fuel container via the gas outlet valve;

an igniting assembly including a piezoelectric member, a piezoelectric pusher, a trigger above the piezoelectric pusher, and a lever, the lever being provided between the piezoelectric pusher and the trigger, a first end of the lever being pivotally connected to the casing, a second end of the lever abutting against the trigger, and a middle part of the lever abutting against the piezoelectric pusher;

a gas controller, one end of the gas controller being connected with the gas outlet valve, another end of the gas controller forming a hook, the hook abutting against the first end of the lever;

a safety spring urging the hook to move beyond a movement range of the first end of the lever, the safety spring being set between one side of the gas controller and the casing; and a controller switch abutting against a back of the hook and being set between the back of the hook and the casing, the controller switch being pivotally connected to the casing, at least a portion of the controller switch being exposed outside the casing.

2. The igniter gun according to claim 1, further comprising:

a locker between the trigger and the controller switch, a middle portion of the locker being pivotally connected to the casing, one end of the locker abutting against the trigger, another end of the locker being connected with a middle portion of the controller switch by a rod, the locker having a movement groove at a connecting position with the controller switch for turning the controller switch.

3. The igniter gun according to claim 1 or 2, wherein one end of the controller switch is pivotally connected to the casing.

4. An igniter gun, comprising:

a casing;

a gun tube above the casing;

a liquefied fuel container within the casing;

a gas outlet assembly including a gas outlet valve and a gas outlet nozzle, one end of the gas outlet nozzle being accommodated in the gun tube, another end of the gas outlet nozzle being connected with the liquefied fuel container via the gas outlet valve;

an igniting assembly including a piezoelectric member, a piezoelectric pusher, a trigger above the piezoelectric pusher, and a lever, the lever being provided between the piezoelectric pusher and the trigger, a first end of the lever being pivotally connected to the casing, a second end of the lever abutting against the trigger, and a middle part of the lever abutting against the piezoelectric pusher;

a gas controller, one end of the gas controller being connected with the gas outlet valve, another end of the gas controller forming a hook, the hook being positionable to abut against the first end of the lever;

a safety spring urging the hook to move beyond a movement range of the first end of the lever, the safety spring being set between one side of the gas controller and the casing; and a controller switch abutting against a back of the hook, the controller switch being set between the back of the hook and the casing, the controller switch being pivotally connected to the casing, at least a portion of the controller switch being exposed outside the casing;

wherein, when the exposed portion of the controller switch is pushed, the controller switch moves the hook against the urging of the spring and to a position within the movement range of the first end of the lever, so that the first end of the lever will lift the hook when the trigger is pushed down, thereby opening the gas outlet valve.

* * * * *